US011150015B2

(12) United States Patent
Spaander et al.

(10) Patent No.: US 11,150,015 B2
(45) Date of Patent: Oct. 19, 2021

(54) CONTROLLING REFRIGERANT COMPRESSION POWER IN A NATURAL GAS LIQUEFACTION PROCESS

(71) Applicant: SHELL OIL COMPANY, Houston, TX (US)

(72) Inventors: Adriaan Spaander, Rijswjk (NL); Srinivas Nurani Ramachandran, Bangalore (IN)

(73) Assignee: SHELL OIL COMPANY, Houston, TX (US)

( * ) Notice: Subject to any disclaimer, the term of this patent is extended or adjusted under 35 U.S.C. 154(b) by 355 days.

(21) Appl. No.: 15/781,490

(22) PCT Filed: Dec. 6, 2016

(86) PCT No.: PCT/EP2016/079893

§ 371 (c)(1),
(2) Date: Jun. 5, 2018

(87) PCT Pub. No.: WO2017/097764

PCT Pub. Date: Jun. 15, 2017

(65) Prior Publication Data

US 2018/0356149 A1 Dec. 13, 2018

(30) Foreign Application Priority Data

Dec. 8, 2015 (IN) ..... IN6543/CHE/2015
Jan. 19, 2016 (EP) ..... 16151934

(51) Int. Cl.
*F25J 1/00* (2006.01)
*F25J 1/02* (2006.01)

(52) U.S. Cl.
CPC ..... *F25J 1/0022* (2013.01); *F25J 1/0052* (2013.01); *F25J 1/0055* (2013.01); *F25J 1/0212* (2013.01);

(Continued)

(58) Field of Classification Search
CPC ..... F25J 1/0022; F25J 1/0052; F25J 1/0055; F25J 1/0212; F25J 1/0214; F25J 1/0216; F25J 1/0284; F25J 1/0252; F25J 1/0292
See application file for complete search history.

(56) References Cited

U.S. PATENT DOCUMENTS 7,114,351 B2 * 10/2006 Jones, Jr. ..... C10L 3/10 62/611
2003/0046953 A1 * 3/2003 Elion ..... F25J 1/0022 62/612

(Continued)

FOREIGN PATENT DOCUMENTS

EA 200501207 A1 2/2006
EP 0893665 A2 1/1999

(Continued)

OTHER PUBLICATIONS

International Search Report and Written Opinion received for PCT Patent Application No. PCT/EP2016/079893, dated Feb. 16, 2017, 9 pages.

*Primary Examiner* — Frantz F Jules
*Assistant Examiner* — Webeshet Mengesha
(74) *Attorney, Agent, or Firm* — Shell Oil Company

(57) ABSTRACT

The present invention relates to a method of controlling the production of a liquefied natural gas product stream (31) obtained by removing heat from natural gas by indirect heat exchange with an expanded heavy mixed refrigerant and an expanded light mixed refrigerant. The method comprises executing a control loop comprising maintaining the flow rate of the liquefied natural gas product stream (31) at a dependent set point and maintaining the flow rates of the heavy mixed refrigerant (60*a*) and the light mixed refrigerant (65) at operator manipulated set points (80, 81). The method further comprises executing an override control loop comprising: determining an override set point (95') for the (Continued)

Figure 1:
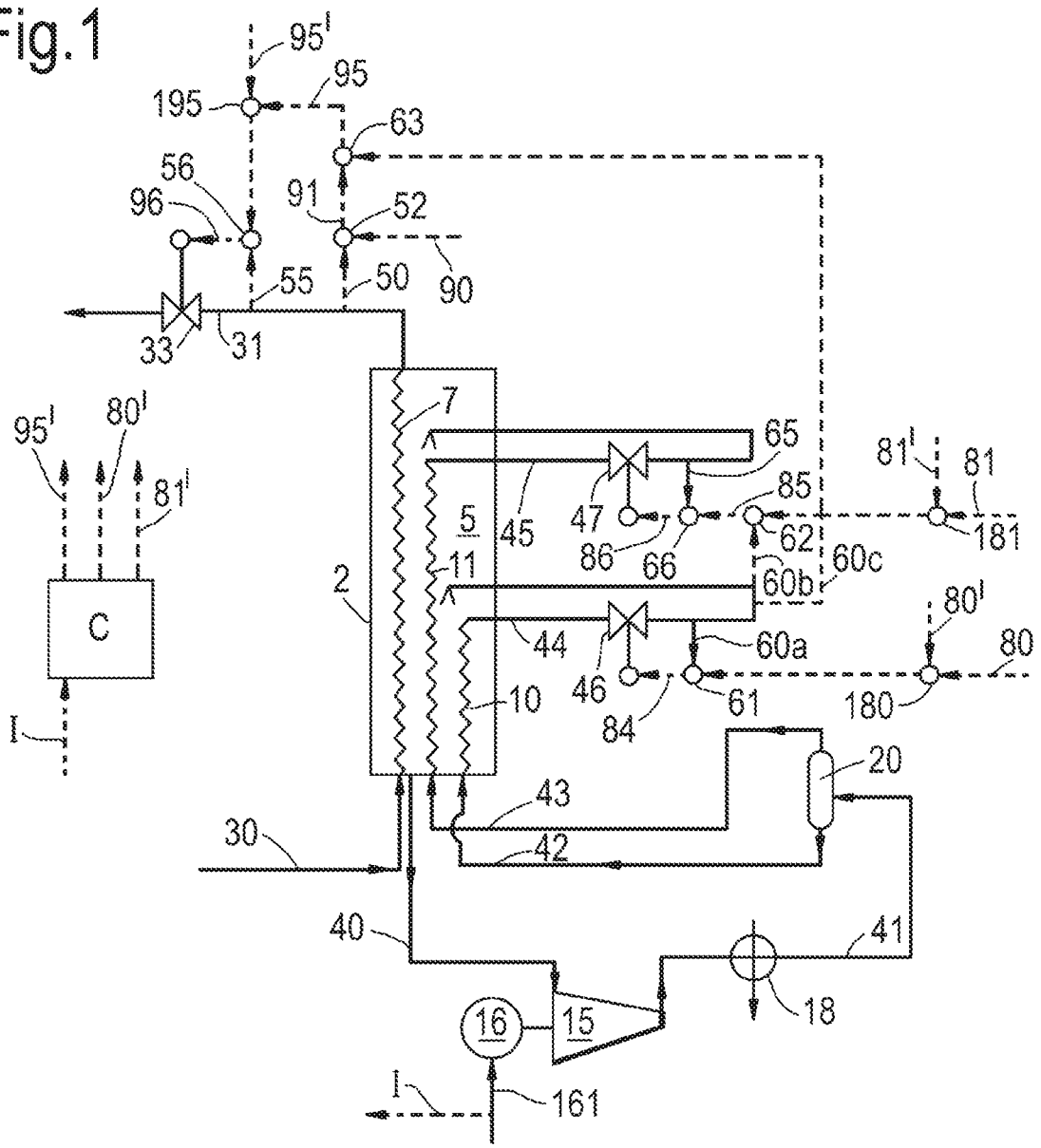

flow rate of the liquefied natural gas and computing an override set point (80') for the flow rate of the heavy mixed refrigerant and an override set point (81') to reduce residual available power of the electric motor.

9 Claims, 2 Drawing Sheets

(52) U.S. Cl.
CPC ..... *F25J 1/0214* (2013.01); *F25J 1/0216* (2013.01); *F25J 1/0252* (2013.01); *F25J 1/0284* (2013.01); *F25J 1/0292* (2013.01)

(56) References Cited

U.S. PATENT DOCUMENTS

| | | | | |
|---|---|---|---|---|
| 2008/0156037 | A1* | 7/2008 | Van De Graaf ..... | F25J 1/0271 62/612 |
| 2012/0079850 | A1* | 4/2012 | Sicinski ..... | F25J 1/0292 62/611 |
| 2016/0040927 | A1* | 2/2016 | Pelagotti ..... | F04D 25/024 62/613 |

FOREIGN PATENT DOCUMENTS

| | | | |
|---|---|---|---|
| EP | 1281033 | A1 | 2/2003 |
| RU | 2170894 | C2 | 7/2001 |

* cited by examiner

CONTROLLING REFRIGERANT COMPRESSION POWER IN A NATURAL GAS LIQUEFACTION PROCESS

PRIORITY CLAIM

The present application is the National Stage (§ 371) of International Application No. PCT/EP2016/079893, filed Dec. 6, 2016, which claims priority from Indian Application No. 6543/CHE/2015, filed Dec. 8, 2015 and European Application No. 16151934.3, filed Jan. 19, 2016 incorporated herein by reference.

The present invention relates to controlling the production of a liquefied natural gas product stream obtained by removing heat from natural gas in a main heat exchanger, wherein the natural gas passes through one set of tubes located in the shell side of the main heat exchanger. In the main heat exchanger, the natural gas is in indirect heat exchange with expanded heavy mixed refrigerant and expanded light mixed refrigerant. The heavy mixed refrigerant and the light mixed refrigerant circulate in a closed refrigeration cycle, which includes the shell side of the main heat exchanger, a compressor, a cooler, a separator, additional sets of tubes in the main heat exchanger and two expansion devices debouching into the shell side, wherein the heavy mixed refrigerant and the light mixed refrigerants are produced as the liquid product and the vapour product from the separator, respectively. In the shell side of the main heat exchanger, the expanded heavy mixed refrigerant and the expanded light mixed refrigerants are allowed to evaporate so as to remove heat from the natural gas passing through the one set of tubes and from the heavy and light mixed refrigerant passing through the two additional sets of tubes in the main heat exchanger.

The main heat exchanger can be a spoolwound main heat exchanger or a plate fin main heat exchanger. In the specification and in the claims the term shell side is used to refer to the cold side of the main heat exchanger and the terms tube and tube bundle are used to refer to the warm side of the main heat exchanger.

Methods of controlling the production of a liquefied natural gas product stream are known from the prior art.

According to European patent application publication No. 893 665 the flow rate of the liquefied natural gas product stream and its temperature are independently controlled, and the flow rate of the total mixed refrigerant is a dependent variable. There are no means to provide real time feedback to the operator on the available power from the gas turbine relative to the power actually consumed. As a consequence, the maximum available power from the turbines that drive the compressors may not be fully utilized.

EP1281033 discloses a method of controlling the production of a liquefied natural gas product stream wherein the temperature of the liquefied natural gas product stream and the flow rate of the mixed refrigerant are controlled, such that the flow rate of the liquefied natural gas product stream is a dependent variable.

According to EP1281033 there is provided a method of controlling the production of a liquefied natural gas product stream obtained by removing heat from natural gas in a heat exchanger in which the natural gas is in indirect heat exchange with expanded heavy mixed refrigerant and expanded light mixed refrigerant comprising the steps of:

1) measuring the temperature and the flow rate of the liquefied natural gas product stream and measuring the flow rates of the heavy mixed refrigerant and of the light mixed refrigerant;

2) selecting the flow rate of one of the refrigerants (the heavy mixed refrigerant, the light mixed refrigerant or the total mixed refrigerant) to have an operator manipulated set point, and generating a first output signal for adjusting the flow rate of the heavy mixed refrigerant and a second output signal for adjusting the flow rate of the light mixed refrigerant using (i) the operator manipulated set point for the flow rate of the one of the refrigerants, (ii) the flow rates of the heavy and light mixed refrigerants and (iii) an operator manipulated set point for the ratio of the flow rate of the heavy mixed refrigerant to the flow rate of the light mixed refrigerant;

3) adjusting the flow rates of the heavy mixed refrigerant and the light mixed refrigerant in accordance with the first and second output signals;

4) determining a dependent set point for the ratio of the flow rate of the liquefied natural gas product stream to the flow rate of one of the refrigerants such that the temperature of the liquefied natural gas product stream is maintained at an operator manipulated set point, and determining a dependent set point for the flow rate of the liquefied natural gas product stream using (i) the dependent set point for the ratio of the flow rate of the liquefied natural gas product stream to the flow rate of the one of the refrigerants and (ii) the flow rate of the one of the refrigerants; and 5) maintaining the flow rate of the liquefied natural gas product stream at its dependent set point.

This control scheme requires the operator to enter set points for

- the temperature of the liquefied natural gas product stream;
- the flow rate of one of the light, the heavy or total mixed refrigerant; and
- the ratio of the flow rate of the heavy mixed refrigerant to the flow rate of the light mixed refrigerant.

The method then sets the flow rates of the heavy and light mixed refrigerants and computes a flow rate of the liquefied natural gas product stream at which a liquefied natural gas product stream can be produced having the set point for the LNG temperature.

The control scheme permits continuous maximum utilization of the available power to drive the compressors in the refrigeration cycle, because the operator can manipulate the flow rates of the heavy mixed refrigerant and the light mixed refrigerant.

This control scheme is very well adapted for use in Dual/Double Mixed Refrigerant (DMR) Processes using mechanical drives for the refrigerant compression train, which provide variable power across the year due to variations in ambient temperature.

EP1281033 has the disadvantage that optimal use of the available power to drive the compressor(s) in the mixed refrigerant cycle depends on knowledge of the available power. EP1281033 relies on an alert operator who has knowledge of available power and the skills to convert that knowledge into operating set points for heavy and light mixed refrigerant flow and LNG temperature. For a gas turbine, the available maximum power that can be generated to drive the compressor(s) is not a fixed value, but varies with several operating conditions, including and in particular ambient air temperature.

It is an object to provide an improved control scheme that allows for a more reliable optimization of the available power to drive the compressor(s) in mixed refrigerant cycles.

According to an aspect there is provided a method of controlling the production of a liquefied natural gas product stream (31) obtained by removing heat from natural gas in a main heat exchanger (2) in which the natural gas is in indirect heat exchange with an expanded heavy mixed refrigerant and an expanded light mixed refrigerant, wherein the method comprises circulating the heavy and light mixed refrigerant through a refrigerant cycle, the refrigerant cycle comprising a centrifugal compressor (15) driven by an electric motor (16), wherein the method comprises executing a control loop comprising:

a) determining a dependent set point (95) for the flow rate of the liquefied natural gas product stream (31) based on operator manipulated set points for (i) a flow rate of one of the refrigerants (the heavy mixed refrigerant (80), the light mixed refrigerant (81) or the total mixed refrigerant), (ii) a ratio of the flow rate of the heavy mixed refrigerant to the flow rate of the light mixed refrigerant, and (iii) a temperature of the liquefied natural gas product stream (90), determining the operator manipulated set point (80) for the flow rate of the heavy mixed refrigerant (60*a*) and the operator manipulated set point (81) for the flow rate of the light mixed refrigerant (65), wherein determining the dependent set point for the flow rate of the liquefied natural gas product stream comprises determining a dependent set point for the ratio of the flow rate of the liquefied natural gas product stream to the flow rate of one of the refrigerants such that the temperature of the liquefied natural gas product stream is maintained at the operator manipulated set point for the temperature of the liquefied natural gas product stream (90), maintaining the flow rate of the liquefied natural gas product stream (31) at its dependent set point and maintaining the flow rates of the heavy mixed refrigerant (60*a*) and the light mixed refrigerant (65) at the operator manipulated set points (80, 81) for the flow rates of the heavy mixed refrigerant and the light mixed refrigerant respectively, wherein the method comprises executing an override control loop comprising:

b) determining a residual available power value of the electric motor by determining an actual power consumption of the electric motor and compare the actual power consumption to a predetermined maximal power consumption of the electric motor;

c) if the residual available power exceeds a predetermined threshold, determining an override set point (95') for the flow rate of the liquefied natural gas;

d) computing an override set point (80') for the flow rate of the heavy mixed refrigerant and an override set point (81') for the flow rate of the light mixed refrigerant associated to the override set point (95') for the flow rate of the liquefied natural gas to maintain the operated manipulated set point for the temperature of the liquefied natural gas product stream, e) overriding the dependent set point (95) for the flow rate of the liquefied natural gas product stream with the override set point (95') for the flow rate of the liquefied natural gas and overriding the operator manipulated set points (80, 81) for the flow rates of the heavy mixed refrigerant and the light mixed refrigerant with the override set points (80', 81') for the flow rates of the heavy mixed refrigerant and the light mixed refrigerant respectively.

The above described method is based on the insight that in an electric motor driven liquefaction process, i.e. in a liquefaction process in which the power to drive the centrifugal compressor(s) in the mixed refrigerant cycle is provided by an electric motor, the control scheme can be further improved due to the fact that an electric motor has a fixed maximum power output and the current power consumption of an electric motor can be determined relatively easily and accurately. The need for operator intervention is thereby eliminated or at least reduced.

Centrifugal compressors operate according to a compressor specific pressure ratio versus volume flow characteristic, for instance known as the compressor characteristic. The pressure ratio is the ratio of the outlet pressure versus the inlet pressure and the volume flow is the volume flow flowing through the suction of the centrifugal compressor.

For centrifugal compressors, the pressure ratio is substantially inversely proportional to the volume flow, of course only within the working area of the centrifugal compressor as represented by the compressor characteristic.

The override set points for the flow rates of the heavy mixed refrigerant and the light mixed refrigerant are higher than the operator manipulated set points for the flow rates of the heavy mixed refrigerant and the light mixed refrigerant in the event that positive residual power is available in the electric motors.

The actual power consumption of the electric motor is also a function of the pressure ratio and the flow rate, but depends much stronger on the flow rate than on the pressure ratio. As a result of the override set points for the flow rates of the heavy mixed refrigerant and the light mixed refrigerant, the pressure ratio delivered by the centrifugal compressor will be somewhat smaller. However, because the influence of the increased flow rates is larger on the actual power consumption, the actual power consumption of the electric motor will increase and the residual available power will be reduced.

So, in case the determined residual available power value of the electric motor is above a predetermined threshold value (the threshold value may be zero), the override control loop overrides the dependent set point for the flow rate of the liquefied natural gas product stream determined in (a). This causes increased refrigerant flows (via the ratio of the flow rate of the liquefied natural gas product stream to the flow rate of one of the refrigerants determined in (a)) and consequently causes the centrifugal compressor to deliver additional work, thereby bringing the residual available power value of the electric motor closer to zero.

Thereby, dependence on operator to know the available power and manually adjust the process to maximize use is eliminated.

The method requires knowledge of a predetermined maximal power consumption of the electric motor as input. The predetermined maximal power consumption may be based on specifications provided by the manufacturer or supplier of the electric motor or may be an operator determined value. The operator determined value may for instance be a percentage of the predetermined maximal power consumption based on the specifications provided by the manufacturer or supplier of the electric motor, typically 90%, 95%, 98% or 100%.

According to an embodiment step a) further comprises a1) measuring the temperature (50) of the liquefied natural gas product stream (33).

According to an embodiment step b) further comprises a2) selecting the flow rate of one of the refrigerants (the heavy mixed refrigerant, the light mixed refrigerant or the total mixed refrigerant) to have an operator manipulated set point, and generating a first output signal for adjusting the flow rate of the heavy mixed refrigerant and a second output signal for adjusting the flow rate of the light mixed refrigerant using (i) the operator manipulated set point for the flow rate of the one of the refrigerants, (ii) the flow rates of the heavy and light mixed refrigerants and (iii) an operator manipulated set point for the ratio of the flow rate of the heavy mixed refrigerant to the flow rate of the light mixed refrigerant;

a3) adjusting the flow rates of the heavy mixed refrigerant and the light mixed refrigerant in accordance with the first and second output signals;

a4) determining a dependent set point for the ratio of the flow rate of the liquefied natural gas product stream to the flow rate of one of the refrigerants such that the temperature of the liquefied natural gas product stream is maintained at an operator manipulated set point, and determining a dependent set point for the flow rate of the liquefied natural gas product stream using (i) the dependent set point for the ratio of the flow rate of the liquefied natural gas product stream to the flow rate of the one of the refrigerants and (ii) the flow rate of the one of the refrigerants.

According to an embodiment determining an actual power consumption of the electric motor comprises obtaining an indication of the actual electric current (I) consumed by the electric motor (16).

The actual power consumption of the electric motor can be calculated from a measurement of the electric current drawn by the electric motor. Computing the actual power consumption from the electric current consumed by the electric motor can be done by any suitable known manner and may include determining the actual electric voltage supplied to the electric motor. This allows a simple method to calculate Residual Available Power (RAP).

According to an embodiment the production of liquefied natural gas product stream (31) comprises removing heat from natural gas in a pre-cool heat exchanger in which the natural gas is in indirect heat exchange with an expanded pre-cool refrigerant, to obtain a pre-cooled natural gas stream, wherein the method comprises circulating the pre-cool refrigerant through a pre-cool refrigerant cycle, the pre-cool refrigerant cycle comprising a centrifugal pre-cool centrifugal compressor driven by an pre-cool electric motor, wherein the method comprises passing the pre-cooled natural gas stream to the main heat exchanger in which the natural gas is in indirect heat exchange with the expanded heavy mixed refrigerant and the expanded light mixed refrigerant, wherein the override control loop further comprises:

b1) determining a pre-cool residual available power value of the pre-cool electric motor by determining an actual power consumption of the pre-cool electric motor and compare the actual power consumption to a predetermined maximal power consumption of the pre-cool electric motor;

b2) select the smallest of the pre-cool residual available power value and the residual available power value, and continue with executing steps c) and d) based on the selected one of the pre-cool residual available power value and the residual available power value.

The override control loop hereby takes into account the residual available power of the different centrifugal compressors and prevents an overload trip of the more loaded centrifugal compressor by determining an override dependent set point for the flow rate of the liquefied natural gas based on the smallest residual available power.

According to an embodiment, step c) comprises selecting the override dependent set point for the flow rate of the liquefied natural gas to equal the dependent set point for the flow rate of the liquefied natural gas product stream under a) plus a predetermined step size.

Preferably, the predetermined step size is selected depending on the residual available power as determined in step (b). The predetermined step size may for instance be a function of the residual available power or a look-up table may be available in which sets of residual available power values and associated step sizes are stored.

Preferably, the smaller the residual available power, the smaller the predetermined step size. This is done to prevent the power consumption of the electric motor from overshooting the predetermined maximal power consumption of the electric motor.

The predetermined step size may be expressed as a percentage or as an absolute value representing an amount of flow rate (e.g. in litres per second) to be added to the flow rate of the liquefied natural gas product stream.

Steps (b), (c), (d) and (e) (see below) may be repeated and function to lower the residual available power in an iterative manner. Repetition of steps (b), (c), (d) and (e) may be performed after a predetermined time interval or once it has been established that the previously executed override control loop (steps (b), (c), (d) and (e)) has resulted in a stabilized working condition.

According to an embodiment the override control loop further comprises f) after steps b), c) d) and e) have been performed, monitoring at least one of the following parameters:

the residual available power value of the electric motor, the actual power consumption of the electric motor, the flow rate of the liquefied natural gas product stream, the flow rate of the heavy mixed refrigerant, the flow rate of the light mixed refrigerant, the temperature of the liquefied natural gas product stream, and repeat steps b), c), d) and e) once the monitored parameters are stable.

According to an embodiment the control loop is executed by one or more controllers (C).

The control loop may be executed by a single controller. Alternatively, step (a) may be performed by a first controller, and steps (b)-(f) may be performed by a second override controller.

The controller (C) may be embodied as a computer. The controller may comprise a processing unit, a memory unit and an input/output unit, wherein the processing unit is arranged to read and write data and instructions from and to the memory unit and receive and transmit data and instructions via the input/output unit from and to parts of the plant for the production of a liquefied natural gas product stream. The memory unit may comprise instructions readable and executable by the processing unit to provide the controller with the functionality to perform the control loop.

According to a further aspect there is provided a system for the production of a liquefied natural gas product stream (31) comprising a main heat exchanger (2) arranged to remove heat from natural gas by indirect heat exchange with an expanded heavy mixed refrigerant and an expanded light mixed refrigerant, the system comprising a refrigerant cycle arranged to circulate the heavy and light mixed refrigerant, the refrigerant cycle comprising the main heat exchanger (2) and a centrifugal compressor (15) driven by an electric motor (16), wherein the system comprises a controller (C) arranged to perform the any one of the methods described above.

Figure 2:
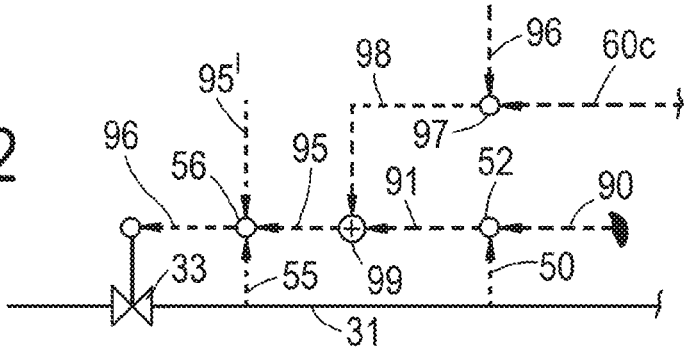

The invention will now be described by way of example in more detail with reference to the accompanying drawings, wherein FIG. 1 schematically shows a flow scheme of a liquefaction plant provided according to an embodiment;

FIG. 2 schematically shows an alternative control; and

Figure 3:
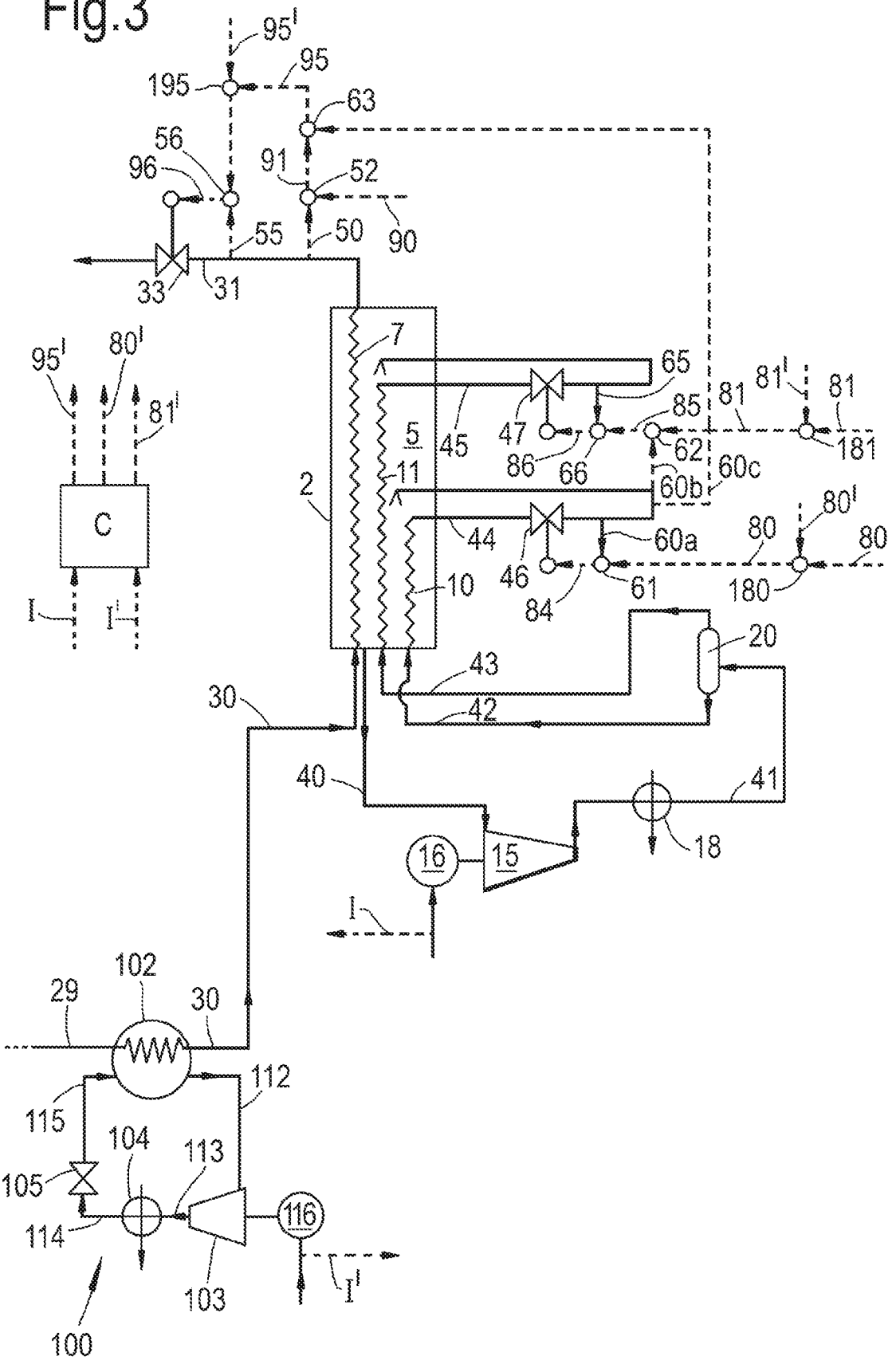

FIG. 3 schematically shows an alternative embodiment.

Reference is now made to FIG. 1. The plant for liquefying natural gas comprises a main heat exchanger 2 having a shell side 5. The main heat exchanger 2 may also be referred to as the main cryogenic heat exchanger 2. In the shell side are arranged three tube bundles 7, 10 and 11. The plant further comprises a centrifugal compressor 15 driven by a suitable electric motor or electric driver 16, a refrigerant cooler 18 and a separator 20.

During normal operation, natural gas is supplied at liquefaction pressure through conduit 30 to the first tube bundle 7 in the main heat exchanger 2. This may also be referred to as natural gas stream 30.

The natural gas stream 30 may be a pre-cooled natural gas stream 30 which is pre-cooled in a pre-cool heat exchanger, as will be further described with reference to FIG. 3.

The natural gas flowing through the first tube bundle 7 is cooled, liquefied and sub-cooled. The sub-cooled liquefied natural gas flows out of the main heat exchanger 2 through conduit 31. The conduit 31 is provided with an expansion device in the form of a flow control valve 33 (optionally preceded by an expansion turbine, not shown) to control the flow rate of the liquefied natural gas product stream and to allow storing of the liquefied natural gas product stream at about atmospheric pressure.

Mixed refrigerant used to remove heat from the natural gas in the main heat exchanger 2 circulates through a closed refrigeration cycle. The closed refrigeration cycle includes the shell side 5 of the main heat exchanger 2, conduit 40, the centrifugal compressor 15, conduit 41, the cooler 18 arranged in the conduit 41, the separator 20, conduits 42 and 43, the two tube bundles 10, 11 in the main heat exchanger 2, and conduits 44 and 45 debouching into the shell side 5. The conduits 44 and 45 are provided with expansion devices in the form of flow control valves 46 and 47. The flow control valves 46 and 47 can optionally be preceded by an expansion turbine, not shown.

The gaseous refrigerant, which flows from the shell side 5 of the main heat exchanger 2 is compressed by the centrifugal compressor 15 to a high pressure. In the cooler 18 the heat of compression is removed and the mixed refrigerant is partially condensed. Cooling and partial condensation of the mixed refrigerant may also be done in more than one main heat exchanger. In the separator 20, the mixed refrigerant is separated into heavy mixed refrigerant and light mixed refrigerant, which are the liquid product and the vapour product, respectively.

Heavy mixed refrigerant is passed through the conduit 42 to the second tube bundle 10, in which it is sub-cooled. Light mixed refrigerant is passed through conduit 43 to the third tube bundle 11, in which it is liquefied and sub-cooled.

Sub-cooled heavy mixed refrigerant and light mixed refrigerant are passed via the flow control valves 46 and 47 into the shell side 5, where they are allowed to evaporate at a low pressure so as to remove heat from the natural gas in the first tube bundle 7 and from the refrigerants passing through the additional tube bundles 10 and 11.

According to this embodiment the production of the liquefied natural gas product stream is controlled in the following way (corresponding to step (a) described above).

First of all the temperature and the flow rate of the liquefied natural gas product stream flowing through the conduit 31 are measured. The temperature measurement signal, referred to with reference numeral 50, is passed to a temperature controller 52. The flow rate measurement signal, referred to with reference numeral 55 is passed to a first flow rate controller 56.

In addition, the flow rates of the heavy mixed refrigerant and of the light mixed refrigerant passing through conduits 44 and 45 respectively are measured. The heavy mixed refrigerant flow rate measurement signals, referred to with reference numerals 60*a*, 60*b* and 60*c*, are passed to a second flow rate controller 61, to a first flow ratio controller 62 and to a second flow ratio controller 63, respectively. The light mixed refrigerant flow rate measurement signal, referred to with reference numeral 65 is passed to a third flow rate controller 66.

The next step comprises controlling the flow rates of the refrigerants. At first, the flow rate of one of the refrigerants (the heavy mixed refrigerant, the light mixed refrigerant or the total mixed refrigerant) is selected to have an operator manipulated set point. In the embodiment of FIG. 1 the heavy mixed refrigerant is selected to have an operator manipulated set point, which is a set point signal referred to with reference numeral 80 that is supplied to the second flow rate controller 61.

The flow rate of the heavy mixed refrigerant is controlled using (i) the operator manipulated set point 80 for the flow rate of the heavy mixed refrigerant and (ii) the measured flow rate 60*a* of the heavy mixed refrigerant.

A difference between the measured flow rate 60*a* of the heavy mixed refrigerant and its operator manipulated set point 80 causes the second flow rate controller 61 to generate an output signal 84 that adjusts the position of the flow control valve 46. The adjustment is such that the absolute value of the difference is below a predetermined norm.

The flow rate of the light mixed refrigerant is controlled using (i) the measured flow rates 60*b* and 65 of the heavy and the light mixed refrigerant and (ii) an operator manipulated set point 81 for the ratio of the flow rate of the heavy mixed refrigerant to the flow rate of the light mixed refrigerant.

The first flow ratio controller 62 divides the measured flow rate 60*b* of the heavy mixed refrigerant by the operator manipulated set point 81 for the ratio of the flow rates of heavy mixed refrigerant and light mixed refrigerant to generate an output signal 85 that is the dependent set point for the third flow rate controller 66. Then a difference between the measured flow rate 65 of the light mixed refrigerant and its dependent set point 85 causes the third flow rate controller 66 to generate a second output signal 86 that adjusts the position of the flow control valve 47. The adjustment is such that the absolute value of the difference is below a predetermined norm. In an alternative embodiment (not shown) a difference between the ratio of the measured flow rate 60*b* of the heavy mixed refrigerant to the measured flow rate 65 of the light mixed refrigerant and the operator manipulated set point 81 for this ratio, causes the first flow ratio controller 62 to generate an output signal 85 that is the dependent set point for the third flow rate controller 66. Then a difference between the measured flow rate 65 of the light mixed refrigerant and its dependent set point 85 causes the third flow rate controller 66 to generate a second output signal 86 that adjusts the position of the flow control valve 47. The adjustment is such that the absolute value of the difference is below a predetermined norm.

In this way the flow rates of the heavy mixed refrigerant and the light mixed refrigerants are controlled.

Secondly the temperature of the liquefied natural gas product stream is controlled. To this end, a dependent set point for the ratio of the flow rate of the liquefied natural gas product stream to the flow rate of one of the refrigerants (in this case the heavy mixed refrigerant) is determined such that the temperature of the liquefied natural gas product steam is maintained at an operator manipulated set point. The operator manipulated set point for the temperature of the liquefied natural gas product stream is a set point signal referred to with reference numeral 90 that is supplied to the temperature controller 52.

A difference between the temperature 50 of the liquefied natural gas product stream and its operator manipulated set point 90 causes the temperature controller 52 to generate an output signal that is the dependent set point 91 for the second flow ratio controller 63. Using the measured flow rate 60*c* of the heavy mixed refrigerant the second flow ratio controller 63 generates an output signal 95 that is the dependent set point for the flow rate of the liquefied natural gas product stream. A difference between the measured flow rate 55 of the liquefied natural gas product stream and its dependent set point 95 causes the first flow rate controller 56 to generate an output signal 96 that adjusts the position of the flow control valve 33. The adjustment is such that the absolute value of the difference is below a predetermined norm.

In this way the flow rate of the liquefied natural gas product stream is controlled in such a way that the temperature of the liquefied natural gas product stream is maintained at its operator manipulated set point.

There are two alternatives for controlling the flow rates of the refrigerants. In the first alternative, the flow rate of the light mixed refrigerant is selected to have an operator manipulated set point. The method then comprises generating a second output signal for adjusting the flow rate of the light mixed refrigerant using the operator manipulated set point for the flow rate of the light mixed refrigerant, and generating a first output signal for adjusting the flow rate of the heavy mixed refrigerant using (i) the measured flow rates of the heavy mixed refrigerant and of the light mixed refrigerant and (ii) an operator manipulated set point for the ratio of the flow rate of the heavy mixed refrigerant to the flow rate of the light mixed refrigerant.

In the second alternative the flow rate of the total mixed refrigerant is selected to have an operator manipulated set point. The method then comprises generating a first output signal for adjusting the flow rate of the heavy mixed refrigerant and a second output signal for adjusting the flow rate of the light mixed refrigerant using (i) the operator manipulated set point for the flow rate of the total mixed refrigerant, (ii) the measured flow rates of the heavy and light mixed refrigerants and (iii) an operator manipulated set point for the ratio of the flow rate of the heavy mixed refrigerant to the flow rate of the light mixed refrigerant.

There are several alternatives for controlling the temperature of the liquefied natural gas product stream. In the first alternative, a dependent set point for the ratio of the flow rate of the liquefied natural gas product stream to the flow rate of the light mixed refrigerant is determined such that the temperature of the liquefied natural gas product stream is maintained at the operator manipulated set point. The method then comprises determining a dependent set point for the flow rate of the liquefied natural gas product stream using (i) the dependent set point for the ratio of the flow rate of the liquefied natural gas product stream to the flow rate of the light mixed refrigerant and (ii) the measured flow rate of the light mixed refrigerant.

In the second alternative a dependent set point for the ratio of the flow rate of the liquefied natural gas product stream to the flow rate of the total mixed refrigerant is determined such that the temperature of the liquefied natural gas product stream is maintained at the operator manipulated set point. The method then comprises determining a dependent set point for the flow rate of the liquefied natural gas product stream using (i) the dependent set point for the ratio of the flow rate of the liquefied natural gas product stream to the flow rate of the total mixed refrigerant and (ii) the measured flow rate of the total mixed refrigerant.

Reference is made to FIG. 2, which shows a further alternative. Parts shown in FIG. 2 that are identical to parts shown in FIG. 1 are given the same reference numerals. In this alternative embodiment, the ratio of the flow rate of the liquefied natural gas product stream to the flow rate of the heavy mixed refrigerant is not determined so as to control the temperature, but it is an operator manipulated set point 96, which is a set point signal supplied to a third ratio controller 97. The third ratio controller 97 generates a first output signal 98 using (i) the operator manipulated set point 96 for the ratio of the flow rate of the liquefied natural gas product stream to the flow rate of the heavy mixed refrigerant and (ii) the measured flow rate 60*c* of the heavy mixed refrigerant. The temperature controller 52 generates a second output signal 91 using the operator manipulated set point 90 for the temperature and the measured temperature 50. The output signals are each multiplied with a separate weighting factor and the weighted signals are then added in adder 99 to obtain the dependent set point 95 for the flow rate of the liquefied natural gas product stream.

Alternatively, the flow rate of the light mixed refrigerant is used or the flow rate of the total mixed refrigerant.

Using both the ratio and the temperature to control the flow rate of the liquefied natural gas product stream is particularly suitable, when the flow rate measurement is not too accurate. When the flow rate measurement signal is not accurate, the weighting factor applied to the first output signal 98 can have a low value.

The liquefaction plant is provided with means (not shown) to measure or determine the actual power consumption of the electric motor 16. Determining the actual power consumption also includes determining a parameter which forms an indication of the actual power consumption.

In the embodiment shown in FIG. 1, the first flow ratio controller 62 controls the dependent set point 85 of the third flow rate controller 66 using the measured flow rate of the heavy mixed refrigerant and the operator manipulated set point 80 for the ratio between the flow rate of the heavy mixed refrigerant to the flow rate of the light mixed refrigerant. Alternatively, this ratio can be the ratio of the ratio of the flow rate of the heavy mixed refrigerant to the flow rate of the total mixed refrigerant or the ratio of the flow rate of the light mixed refrigerant to the flow rate of the total mixed refrigerant.

Above description with reference to FIG. 1 shows a method of controlling the production of a liquefied natural gas product stream (31) obtained by removing heat from natural gas in a main heat exchanger (2) in which the natural gas is in indirect heat exchange with an expanded heavy mixed refrigerant and an expanded light mixed refrigerant. The method comprises circulating the heavy and light mixed refrigerant through a refrigerant cycle, the refrigerant cycle comprising a centrifugal compressor (15) driven by an electric motor (16).

The method comprises executing a control loop comprising:

a) determining a dependent set point (95) for the flow rate of the liquefied natural gas product stream (31) based on operator manipulated set points for (i) a flow rate of one of the refrigerants (the heavy mixed refrigerant (80), the light mixed refrigerant (81) or the total mixed refrigerant), (ii) a ratio of the flow rate of the heavy mixed refrigerant to the flow rate of the light mixed refrigerant, and (iii) a temperature of the liquefied natural gas product stream (90), determining the operator manipulated set point (80) for the flow rate of the heavy mixed refrigerant (60*a*) and the operator manipulated set point (81) for the flow rate of the light mixed refrigerant (65), wherein determining the dependent set point for the flow rate of the liquefied natural gas product stream comprises determining a dependent set point for the ratio of the flow rate of the liquefied natural gas product stream to the flow rate of one of the refrigerants such that the temperature of the liquefied natural gas product stream is maintained at the operator manipulated set point for the temperature of the liquefied natural gas product stream (90), maintaining the flow rate of the liquefied natural gas product stream (31) at its dependent set point and maintaining the flow rates of the heavy mixed refrigerant (60*a*) and the light mixed refrigerant (65) at the operator manipulated set points (80, 81) for the flow rates of the heavy mixed refrigerant and the light mixed refrigerant respectively.

Next, the override control loop will be described in more detail with reference to FIG. 1. FIG. 1 schematically depicts a controller C which may be used to execute the override control loop, possibly in addition to executing step (a).

As schematically depicted in FIG. 1, the electric motor 16 is fed with electricity via electrical connection 161.

The controller C receives measurement of the electric current I supplied to the electric motor 16 and determines the actual power consumption of the electric motor 16 based on the measured electric current.

Next the controller determines a residual available power value of the electric motor 16 by comparing, in particular subtracting the actual power consumption from the predetermined maximal power consumption of the electric motor 16 (step (b)).

The residual available power value may be expressed as a percentage of the predetermined maximal power consumption. According to an example, the residual available power value may be 4%, meaning that 96% of the predetermined maximal power consumption is used.

In a next step (step (c)), the residual available power value is compared to a predetermined threshold. The threshold may be 0%, but may also be set to a positive value close to 0%. This is done to prevent small temporary fluctuations in the actual power consumption to trigger the override loop from taking action.

If the residual available power value exceeds the predetermined threshold, an override set point 95' for the flow rate of the liquefied natural gas is set.

The override set point 95' for the flow rate of the liquefied natural gas may for instance be set by increasing the dependent set point for the flow rate of the liquefied natural gas product stream 95 under a) with a predetermined step size.

Next, the controller (C) computes an override set point 80' for the flow rate of the heavy mixed refrigerant and an override set point 81' the light mixed refrigerant associated to the override set point 95' for the flow rate of the liquefied natural gas to maintain the operated manipulated set point for the temperature of the liquefied natural gas product stream.

Next, in step (e) the override set points 80', 81', 95' are used to override the dependent set point 95 for the flow rate of the liquefied natural gas product stream with the override set point 95' for the flow rate of the liquefied natural gas;

the operator manipulated set points 80 for the flow rates of the heavy mixed refrigerant with the override set point 80' for the flow rate of the heavy mixed refrigerant, and the operator manipulated set points 81 for the flow rates of the light mixed refrigerant with the override set point 81' for the flow rate of the light mixed refrigerant.

Overriding the different set points with the associated override set point may be done in different suitable ways. By way of example, FIG. 1 shows override switches 180, 181, 195, which are arranged to pass on the set points (80, 81, 95) unless an override set point (80', 81', 95') is provided. However, alternative manners to perform the actual override may be conceived. In particular, when controller C is also arranged to perform the control loop under step (a), the override may simply take place inside the controller C.

FIG. 2 also shows override set point 95' for the flow rate of the liquefied natural gas.

FIG. 3 further shows a similar flow scheme of a similar liquefaction plant, now additionally comprising a (closed) pre-cool refrigerant cycle 100.

The pre-cool refrigerant cycle 100 comprises a pre-cool heat exchanger 102 in which a natural gas feed stream 29 is in indirect heat exchange with an expanded pre-cool refrigerant to obtain a pre-cooled natural gas stream 30. The pre-cooled natural gas stream 30 is passed to the main heat exchanger 2 via conduit 30, as described above with reference to FIG. 1.

The pre-cool refrigerant may for instance be propane or a mixed refrigerant.

The pre-cool heat exchanger 102 is shown as a single heat exchanger, but it will be understood that in practice the pre-cool heat exchanger 102 may be formed by one or more heat exchangers positioned in series and/or parallel. The pre-cool heat exchanger 102 may also comprise (refrigerant) cooler 18 as described above with reference to FIG. 1.

The pre-cool refrigerant cycle 100 comprises a closed refrigerant loop comprising the pre-cool heat exchanger 102, conduit 112, a centrifugal pre-cool compressor 103, conduit 113, a pre-cool condenser 104, conduit 114, a pre-cool flow control valves 105 (optionally preceded by an expansion turbine (not shown)) and conduit 115.

In use, the pre-cool refrigerant is circulated through the pre-cool refrigerant cycle. The centrifugal pre-cool compressor 103 is driven by a pre-cool electric motor 116.

In use, the natural gas feed stream 29 is passed through the pre-cool heat exchanger 102 to obtain the pre-cooled natural gas stream 30, which is passed to the main heat exchanger in which the natural gas is in indirect heat exchange with the expanded heavy mixed refrigerant and the expanded light mixed refrigerant.

According to this embodiment, the override control loop further comprises:

b1) determining a pre-cool residual available power value of the pre-cool electric motor 116 by determining an actual power consumption of the pre-cool electric motor 116 and compare the actual power consumption to a predetermined maximal power consumption of the pre-cool electric motor, and b2) select the smallest of the pre-cool residual available power value and the residual available power value, and continue with executing steps c) and d) based on the selected one of the pre-cool residual available power value and the residual available power value.

Determining the pre-cool residual available power value of the pre-cool electric motor 116 may be done in the same manner as determining the residual available power value of the electric motor 16 as described with reference to FIG. 1.

Suitably, the liquefaction plant is further provided with an overcurrent prevention override control loop which is arranged to measure the power delivered by the electric motor 116 and optionally pre-cool electric motor 116 which overcurrent prevention override control loop can override the control loop (step (a) and the override control loop (steps (b)-(f)) described above if the power delivered by the electric motor 16 or optionally the pre-cool electric motor 116 has reached a predetermined maximum value. The overcurrent prevention override ensures that the operator manipulated set point 80 for the flow rate of the heavy mixed refrigerant can no longer be increased and the override control loop manipulated set point for the flow rate of the liquefied natural gas can no longer be increased.

Alternatively, when either the light mixed refrigerant or the total mixed refrigerant has an operator manipulated set point, the means can override one of the latter set points.

The person skilled in the art will readily understand that many modifications may be made without departing from the scope of the invention. For instance, where the word step or steps is used it will be understood that this is not done to imply a specific order. The steps may be applied in any suitable order, including simultaneously.

That which is claimed is:

1. A method of controlling the production of a liquefied natural gas product stream obtained by removing heat from natural gas in a main heat exchanger in which the natural gas is in indirect heat exchange with an expanded heavy mixed refrigerant and an expanded light mixed refrigerant, wherein the method comprises circulating the heavy and light mixed refrigerant through a refrigerant cycle, the refrigerant cycle comprising a centrifugal compressor driven by an electric motor, wherein the method comprises executing a control loop comprising:

a) determining a dependent set point for a flow rate of the liquefied natural gas product stream based on operator manipulated set points for (i) a flow rate of one of the refrigerants (the heavy mixed refrigerant, the light mixed refrigerant or the total mixed refrigerant), (ii) a ratio of the flow rate of the heavy mixed refrigerant to the flow rate of the light mixed refrigerant, and (iii) a temperature of the liquefied natural gas product stream, determining the operator manipulated set point for the flow rate of the heavy mixed refrigerant and the operator manipulated set point for the flow rate of the light mixed refrigerant, wherein determining the dependent set point for the flow rate of the liquefied natural gas product stream comprises determining a dependent set point for the ratio of the flow rate of the liquefied natural gas product stream to the flow rate of one of the refrigerants such that the temperature of the liquefied natural gas product stream is maintained at the operator manipulated set point for the temperature of the liquefied natural gas product stream, maintaining the flow rate of the liquefied natural gas product stream at the dependent set point for the liquefied natural gas product stream and maintaining the flow rates of the heavy mixed refrigerant and the light mixed refrigerant at the operator manipulated set points for the flow rates of the heavy mixed refrigerant and the light mixed refrigerant respectively, wherein the method comprises executing an override control loop comprising:

b) determining a residual available power value of the electric motor by determining an actual power consumption of the electric motor and compare the actual power consumption to a predetermined maximal power consumption of the electric motor;

c) if the residual available power exceeds a predetermined threshold, determining an override set point for the flow rate of the liquefied natural gas;

d) computing an override set point for the flow rate of the heavy mixed refrigerant and an override set point for the flow rate of the light mixed refrigerant associated to the override set point for the flow rate of the liquefied natural gas to maintain the operator manipulated set point for the temperature of the liquefied natural gas product stream, e) overriding the dependent set point for the flow rate of the liquefied natural gas product stream with the override set point for the flow rate of the liquefied natural gas and overriding the operator manipulated set points for the flow rates of the heavy mixed refrigerant and the light mixed refrigerant with the override set points for the flow rates of the heavy mixed refrigerant and the light mixed refrigerant respectively.

2. The method according to claim 1, wherein step a) further comprises a1) measuring the temperature of the liquefied natural gas product stream.

3. The method according to claim 2, wherein step b) further comprises a2) selecting the flow rate of one of the refrigerants (the heavy mixed refrigerant, the light mixed refrigerant or the total mixed refrigerant) to have an operator manipulated set point, and generating a first output signal for adjusting the flow rate of the heavy mixed refrigerant and a second output signal for adjusting the flow rate of the light mixed refrigerant using (i) the operator manipulated set point for the flow rate of the one of the refrigerants, (ii) the flow rates of the heavy and light mixed refrigerants and (iii) an operator manipulated set point for the ratio of the flow rate of the heavy mixed refrigerant to the flow rate of the light mixed refrigerant;

a3) adjusting the flow rates of the heavy mixed refrigerant and the light mixed refrigerant in accordance with the first and second output signals;

a4) determining the dependent set point for the ratio of the flow rate of the liquefied natural gas product stream to the flow rate of one of the refrigerants such that the temperature of the liquefied natural gas product stream is maintained at an operator manipulated set point, and determining a dependent set point for the flow rate of the liquefied natural gas product stream using (i) the dependent set point for the ratio of the flow rate of the liquefied natural gas product stream to the flow rate of the one of the refrigerants and (ii) the flow rate of the one of the refrigerants.

4. The method according to claim 1, wherein determining an actual power consumption of the electric motor comprises obtaining an indication of an actual electric current consumed by the electric motor.

5. The method according to claim 1, wherein the production of the liquefied natural gas product stream comprises removing heat from natural gas in a pre-cool heat exchanger in which the natural gas is in indirect heat exchange with an expanded pre-cool refrigerant, to obtain a pre-cooled natural gas stream, wherein the method comprises circulating the pre-cool refrigerant through a pre-cool refrigerant cycle, the pre-cool refrigerant cycle comprising a centrifugal pre-cool centrifugal compressor driven by a pre-cool electric motor, wherein the method comprises passing the pre-cooled natural gas stream to the main heat exchanger in which the natural gas is in indirect heat exchange with the expanded heavy mixed refrigerant and the expanded light mixed refrigerant, wherein the override control loop further comprises:

b1) determining a pre-cool residual available power value of the pre-cool electric motor by determining an actual power consumption of the pre-cool electric motor and compare the actual power consumption to a predetermined maximal power consumption of the pre-cool electric motor;

b2) select the smallest of the pre-cool residual available power value and the residual available power value, and continue with executing steps c) and d) based on the selected one of the pre-cool residual available power value and the residual available power value.

6. The method according to claim 1, wherein step c) comprises selecting the override dependent set point for the flow rate of the liquefied natural gas to equal the dependent set point for the flow rate of the liquefied natural gas product stream under a) plus a predetermined step size.

7. The method according to claim 1, wherein the override control loop further comprises f) after steps b), c), d) and e) have been performed, monitoring at least one of the following parameters:

the residual available power value of the electric motor, the actual power consumption of the electric motor, the flow rate of the liquefied natural gas product stream, the flow rate of the heavy mixed refrigerant, the flow rate of the light mixed refrigerant, the temperature of the liquefied natural gas product stream, and repeat steps b), c), d) and e) once the monitored parameters are stable.

8. The method according to claim 1, wherein the control loop is executed by one or more controllers (C).

9. A system for the production of a liquefied natural gas product stream comprising a main heat exchanger arranged to remove heat from natural gas by indirect heat exchange with an expanded heavy mixed refrigerant and an expanded light mixed refrigerant, the system comprising a refrigerant cycle arranged to circulate the heavy and light mixed refrigerant, the refrigerant cycle comprising the main heat exchanger and a centrifugal compressor driven by an electric motor, wherein the system comprises a controller (C) arranged to perform the method according to claim 1.

* * * * *